US006458045B1

(12) United States Patent
Chen

(10) Patent No.: US 6,458,045 B1
(45) Date of Patent: Oct. 1, 2002

(54) GOLF CLUB HEAD

(76) Inventor: Archer C. C. Chen, No. 501, 28th Road, Taichung Industrial Park, Taichung (TW)

( * ) Notice: Subject to any disclaimer, the term of this patent is extended or adjusted under 35 U.S.C. 154(b) by 41 days.

(21) Appl. No.: 09/785,244

(22) Filed: Feb. 20, 2001

(51) Int. Cl.[7] ..... A63B 53/04
(52) U.S. Cl. ..... 473/342; 473/345; 473/350
(58) Field of Search ..... 473/324, 325, 473/345, 346, 342, 349, 350; 228/248.1, 248.5, 245, 246, 254

(56) References Cited

U.S. PATENT DOCUMENTS 5,094,383 A * 3/1992 Anderson
5,261,663 A * 11/1993 Anderson
5,282,624 A * 2/1994 Viste
5,871,408 A * 2/1999 Chen
6,209,777 B1 * 4/2001 Tung
6,350,209 B1 * 2/2002 Chen

* cited by examiner

*Primary Examiner*—Sebastiano Passaniti
(74) *Attorney, Agent, or Firm*—Browdy and Neimark, P.L.L.C.

(57) ABSTRACT

A golf club head comprises a main body and a ball-hitting face which is fastened to the main body by a brazing layer and an annular soldering portion. The brazing layer is formed between the back of the ball-hitting plate and an annular joining face of the main body. The brazing layer is formed by solidification of a brazing solder held in a trench circumventing the annular joining face of the main body. The annular soldering portion is formed along an annular joining slit located between the ball-hitting plate and the main body.

2 Claims, 5 Drawing Sheets

GOLF CLUB HEAD

FIELD OF THE INVENTION

The present invention relates generally to a golf club, and more particularly to an improved head of the golf club.

BACKGROUND OF THE INVENTION

As shown in FIG. 1, a golf club head 90 of the prior art comprises a main body 91 and a ball-hitting plate 92 which is fastened to the main body 91 by soldering. The main body 91 is of a shell-like construction and is provided in the front face thereof with an opening 93. The plate 92 covers the opening 93. The main body 91 and the plate 92 are fastened together by two soldering processes. The first process involves the forming of a brazing layer 94 on an annular joining surfaces of the main body 91 and the plate 92 by brazing. The second process involves the forming of an annular soldering portion 95 in a joining slit located between the main body 91 and the plate 92.

The brazing layer 94 is formed by one of two methods. The first method includes a first step in which the joining surfaces are applied with brazing solders before the plate 92 is located on the front surface of the main body 91. The head is heated to cause the solders to melt. Upon completion of solidification of the molten solders, the brazing layer 94 is formed. Another method involves a first step in which the main body 91 and the plate 92 are held together by a clamping tool before the brazing solders are applied in a joining slit between the main body 91 and the plate 92. As the main body 91 and the plate 92 are heated, the joining slit is filled with the molten solders. Upon completion of solidification of the molten solders, the brazing layer 94 is formed.

Such prior art methods as described above have drawbacks. In the first place, the molten solders are apt to be squeezed out of the joining surfaces at the time when the plate 92 is joined with the main body 91. As a result, the interior of the head is provided with an extra weight. The weight and the precision of the head are therefore adversely affected. If the brazing solders are applied on the surface of the head, the slit is devoid of the molten solders. As a result, the structural integrity of the brazing layer is seriously undermined.

SUMMARY OF THE INVENTION

The primary objective of the present invention is to provide a golf club head comprising a main body and a ball-hitting plate, which are securely fastened together by soldering.

The main body is provided in the front face with a cavity and an annular joining surface extending along the fringe of the front face. The annular joining surface is provided with a trench extending along the edge thereof. The plate is joined with the front face of the main body such that a brazing layer is formed between the back of the plate and the annular joining surface of the main body by the brazing solders which are held in the trench. The head is provided in the surface with an annular soldering portion extending along the joining slit.

DETAILED DESCRIPTION OF THE INVENTION

Figure 1:
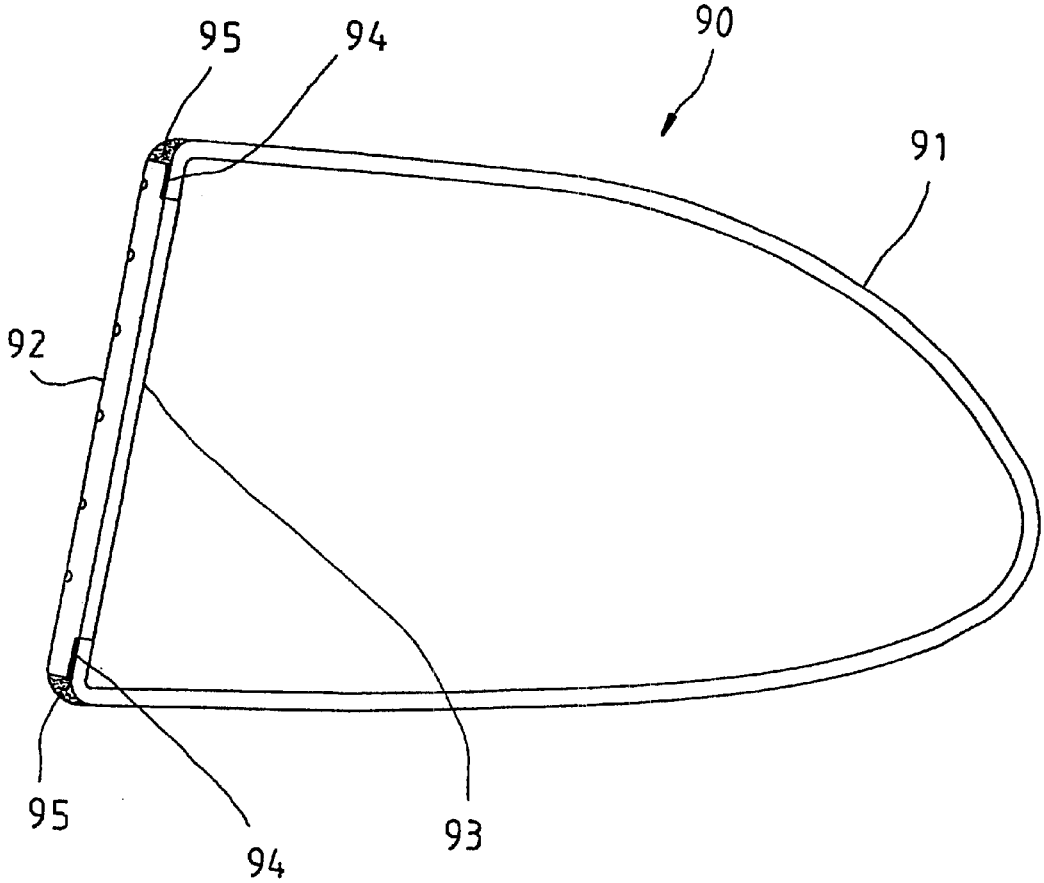
FIG 1 PRIOR ART
FIG. 1 shows a side sectional view of a prior art wooden golf club head.
Figure 2:
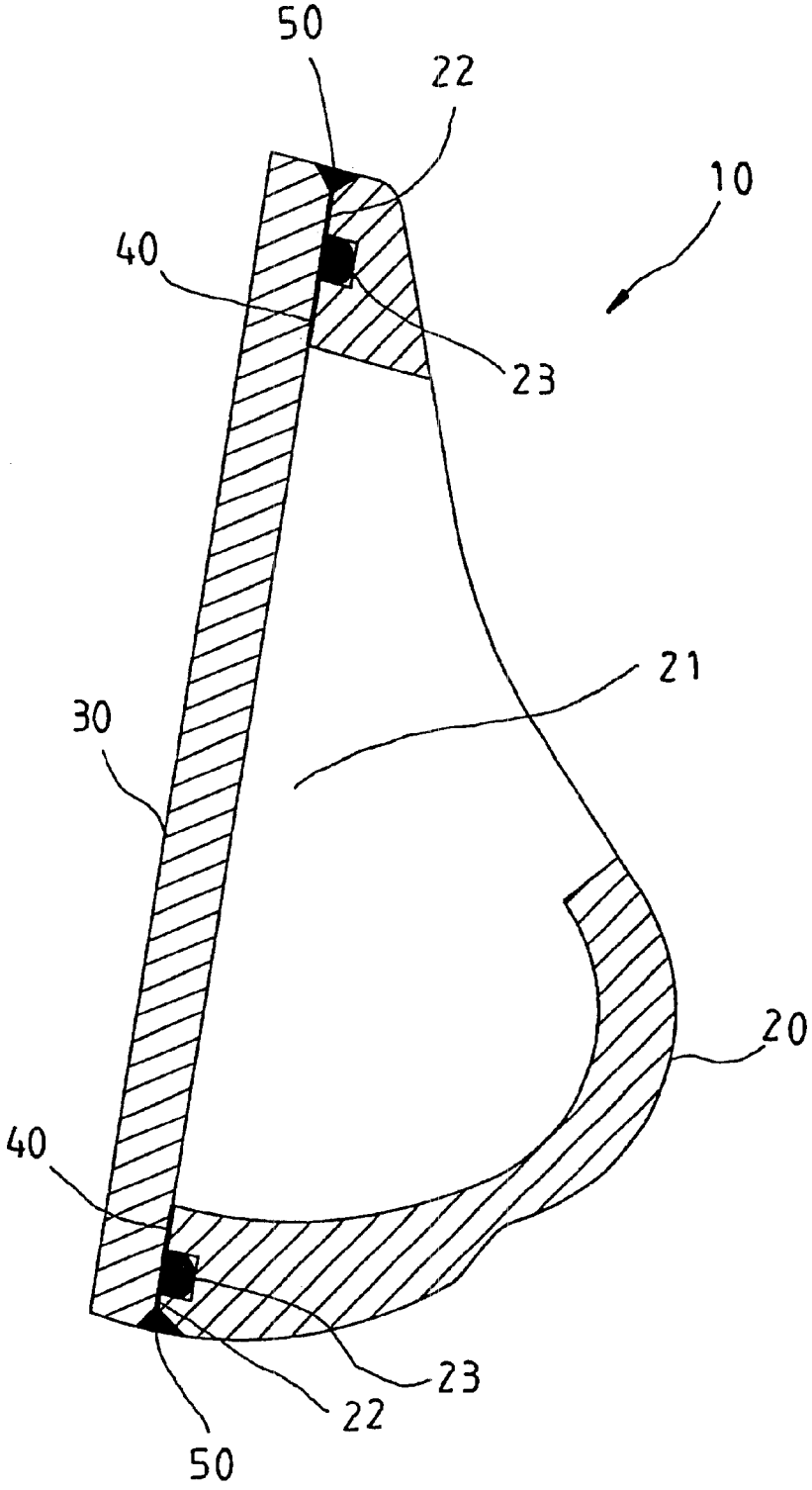
FIG. 2 shows a side sectional view of a golf club head of a first preferred embodiment of the present invention.

As shown in FIG. 2, an iron golf club head 10 of the present invention comprises a main body 20, a ball-hitting plate 30, a brazing layer 40, and an annular soldering portion 50.

The main body 20 is made of metal and is provided with a flat front face having at the center thereof a cavity 21 extending to the back, thereby forming along the fringe of the front face an annular joining face 22 which is provided along the edge with an annular trench 23 for holding solders.

The ball-hitting plate 30 is made of metal and is corresponding in profile to the front face of the main body 20. The plate 30 is joined with the front face of the main body 20 such that the fringe of the back of the plate 30 is attached to the annular joining face 22.

The brazing layer 40 is formed between the back of the plate 30 and the annular joining face 22 of the main body 20 by the solders held in the trench 23. The plate 30 is fastened securely to the main body 20 by the brazing layer 40.

The annular soldering portion 50 is located on the surface of the head 10 such that it extends along the annular joining slit between the plate 30 and the main body 20 for holding the plate 30 and the main body 20 together securely.

Figure 3:
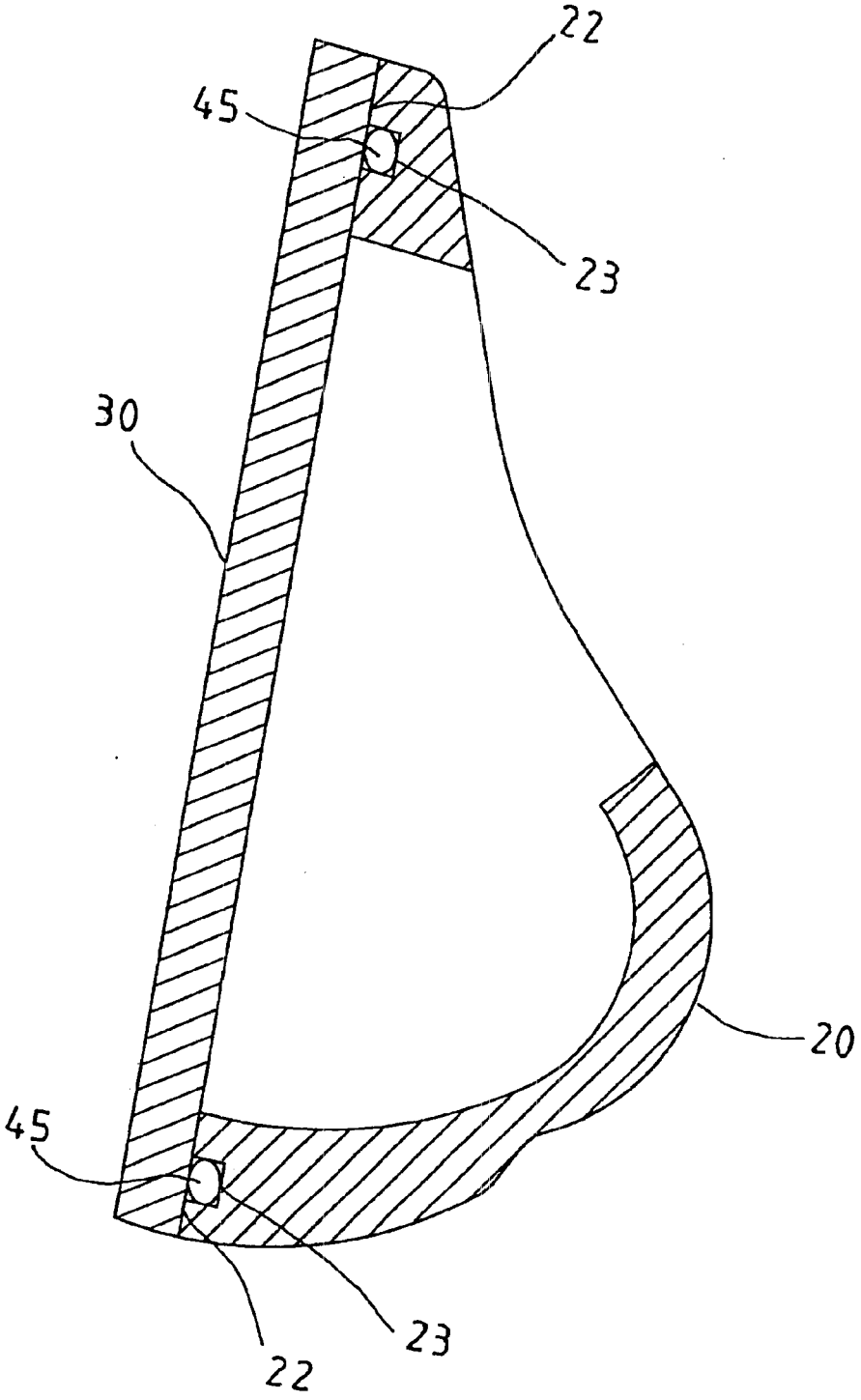
FIGS. 3 and 4 are schematic views of the semifinished products of various steps of the process of the first preferred embodiment of the present invention.
Figure 4:
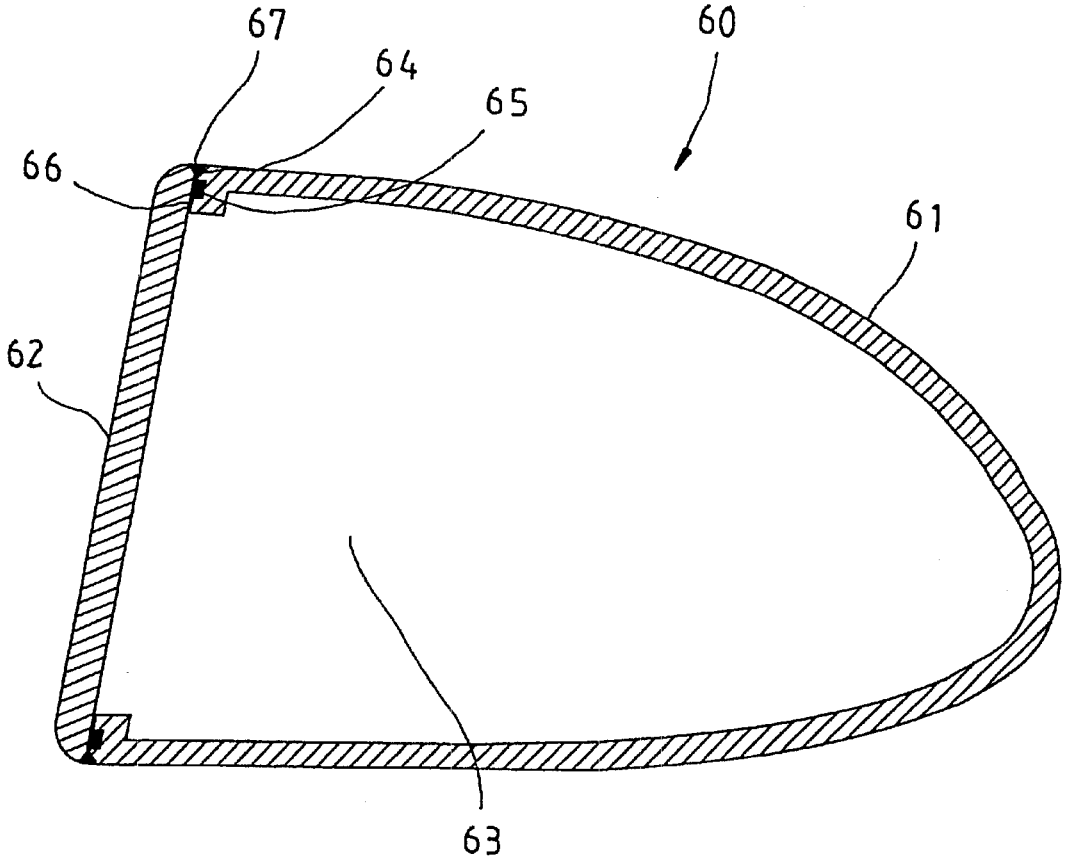

The nickel-based brazing solder ointment 45 is first put into the trench 23 before the plate 30 is joined with the front face of the main body 20 such that the plate 30 and the main body 20 are held together by pressing, point soldering, or clamping, as shown in FIG. 3. The semifinished head is then placed in a vacuum oven such that the front face of the head faces downward. The head is heated at a temperature ranging between 1000 and 1200° C., thereby causing the brazing solder 45 to melt. The molten solder is dispersed by capillarity into the slit between the plate 30 and the main body 20. Upon completion of solidification of the molten solder, the brazing layer 40 is formed, as shown in FIG. 4. Thereafter, the annular soldering portion 50 is formed along the adjoining portions of the plate 30 and the main body 20 by argon soldering. Finally, the surface of the head is polished, coated, or dressed.

The main body 20 and the ball-hitting plate 30 are securely held together by the brazing layer 40 and the annular soldering portion 50. The present invention is provided with the solder-storing trench 23 instead of applying the solder on the joining faces. In light of the trench 23 being near to the annular joining face 22, the molten solder is dispersed to cover entirely the annular joining face 22, thereby resulting in formation of the brazing layer 40 which holds securely the main body 20 and the ball-hitting plate 30 together. In addition, the trench 23 circumvents the annular joining face 22.

Figure 5:
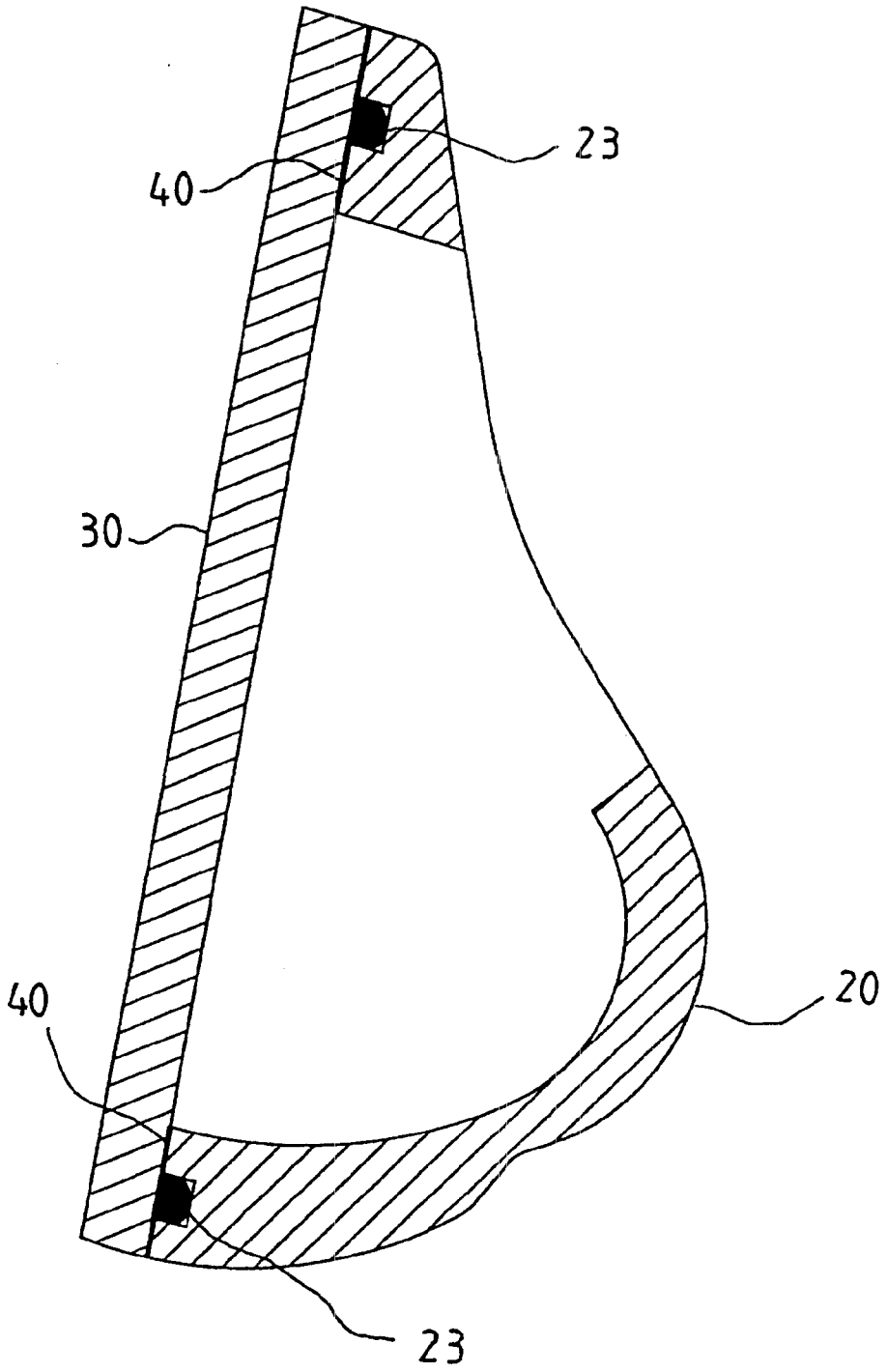
FIG. 5 shows a side sectional view of a golf club head of a second preferred embodiment of the present invention.

As shown in FIG. 5, a wooden golf club head 60 of the second preferred embodiment of the present invention comprises a main body 61 and a ball-hitting plate 62 fastened to the main body 61 by soldering. The main body 61 is provided in the front face with a cavity 63, an annular joining face 64, and a solder-storing trench 65. The plate 62 is fastened to the front face of the main body 61 by a brazing layer 66 which is formed between the back of the plate 62 and the annular joining face 64 of the main body 61. In addition, the main body 61 and the plate 62 are held together by a soldering portion 67 which is formed of metal, matrix, or solder along the joining portions of the plate 62 and the main body 61.

What is claimed is:

1. A golf club head comprising:

a main body made of metal and provided in a front face with a cavity, an annular joining face extending along a fringe of said front face, and a trench circumventing said annular joining face;

a ball-hitting plate made of metal and fastened to said front face of said main body such that an outer edge of the back of said plate is attached to said annular joining face;

a brazing layer formed between the back of said plate and said annular joining face of said main body whereby said brazing layer is formed by solidification of a brazing solder held in said trench of said main body; and an annular soldering portion extending along an annular joining slit between said plate and said main body.

2. The golf club head as defined in claim 1, wherein said trench is annular in form.

* * * * *